US005779984A

United States Patent [19]

Kelly et al.

[11] Patent Number: 5,779,984

[45] Date of Patent: Jul. 14, 1998

[54] PIPETTE TIP RACK AND REFILL PACK CONTAINING LARGE MAXIMIZED VOLUME FREELY NESTABLE PIPETTE TIPS

[75] Inventors: Christopher Kelly, Larkspur; David J. Lemieux, Middleton; Haakon T. Magnussen, Jr., Orinda; James S. Petrek, Danville; Kenneth Rainin, Piedmont, all of Calif.

[73] Assignee: Rainin Intstrumental Co., Inc., Emeryville, Calif.

[21] Appl. No.: 759,409

[22] Filed: Dec. 4, 1996

[51] Int. Cl.[6] ..... B01L 3/02; B65D 85/00

[52] U.S. Cl. ..... 422/104; 422/100; 422/99; 206/486; 211/60.1

[58] Field of Search ..... 422/99, 100, 101, 422/102, 103, 104; 206/486, 562; 211/60.1, 74

[56] References Cited

U.S. PATENT DOCUMENTS

| | | | |
|---|---|---|---|
| 5,324,482 | 6/1994 | Scaramella et al. | 422/100 |
| 5,392,914 | 2/1995 | Lemieux et al. | 206/499 |
| 5,441,702 | 8/1995 | Lemieux et al. | 422/100 |
| 5,445,270 | 8/1995 | Dratz | 206/443 |
| 5,455,008 | 10/1995 | Earley et al. | 422/100 |
| 5,475,610 | 12/1995 | Atwood et al. | 364/500 |
| 5,487,997 | 1/1996 | Stolp | 436/54 |
| 5,612,000 | 3/1997 | Lemieux | 422/100 |
| 5,622,676 | 4/1997 | Lind | 422/104 |
| 5,642,816 | 7/1997 | Kelly et al. | 211/60.1 |

*Primary Examiner*—Harold Y. Pyon
*Attorney, Agent, or Firm*—Robert R. Meads

[57] ABSTRACT

A plurality of large maximized internal volume freely nestable pipette tips for mounting in a standard pipette tip rack or refill pack including a horizontally extending pipette tip support having a plurality of through holes arranged in an array, each hole having a center which is spaced a distance "s" from centers of immediately adjacent through holes, each pipette tip having a substantially cylindrical proximal portion and an elongated generally conical distal portion coaxial with and joined to its proximal portion adjacent a downward facing outwardly extending shoulder and including at a distal end of the tip a relatively small orifice for receiving and dispensing fluid into and from the pipette tip upon operation of a pipette to which the pipette tip is mounted, the proximal portion of each pipette tip having an outer diameter equal to or slightly less than "s" and a slightly conical inner surface for tightly receiving and releasably attaching to a pipette tip mounting shaft of a large volume pipette and the distal portion of each pipette tip in a first array of tips being vertically oriented in a different one of the through holes in the support with its shoulder on a top of the support.

43 Claims, 10 Drawing Sheets

PIPETTE TIP RACK AND REFILL PACK CONTAINING LARGE MAXIMIZED VOLUME FREELY NESTABLE PIPETTE TIPS

BACKGROUND

The present invention relates to improvements in pipette tip racks and refill packs containing large maximized internal volume freely nestable disposable pipette tips for use with single and multiple channel pipette devices and an improved large maximized internal volume freely nestable pipette tip for standard pipette tip racks and standard pipette tip rack refill packs.

The use of pipette devices for the transfer and dispensing of precise quantities of fluids in analytical systems is well known as is the use of disposable tip members for such pipettes. Disposable tips accommodate the serial use of such pipette devices in the transfer of different fluids without carryover or contamination.

Generally speaking, disposable pipette tips are formed of a plastic and are of an elongated conical shape with an open proximal end for receiving and releasably mating with the end of a pipette tip mounting shaft of a pipette device. Ideally, the disposable tip should slide easily onto the mounting shaft to an axial position adjacent to a tip ejection mechanism of the pipette device. Thus located, the pipette tip should be stable on the shaft, free from external rocking relative to the shaft (as during "3touching off"), and form a fluid tight annular seal with the mounting shaft.

Disposable pipette tips are commonly mounted and stored in sterilizable racks. Such racks commonly include a support tray having an array of holes for receiving distal ends of pipette tips to vertically orient the pipette tips in a spaced rectilinear (X, Y) pattern with open proximal ends of the tips exposed to receive the mounting shafts of a pipette device onto which the pipette tips are to be mounted. For example, to mount the disposable pipette tips contained in a tip rack on the shafts of a multi-channel pipette, the pipette device is placed over the rack with the several mounting shafts (e.g. 8) aligned with the open proximal ends of an aligned series (e.g. 8) of the pipette tips. After a slight initial insertion of the mounting shafts into the aligned pipette tips, a relatively large downward force is exerted on the pipette device to drive the pipette shafts into the tip members. The pipette tips are thus firmly seated on the mounting shafts and are lifted from the rack with upward movement of the multi-channel pipette.

The spacing of the pipette tips in the tip rack is critical for such seating of the pipette tips on a multi-channel pipette. In this regard, the spacing of the mounting shafts of multi-channel pipettes is controlled by the center to center spacing of the wells into which fluid is to be dispensed by a multi-channel pipette. The industry standard for such well spacing is approximately 9 millimeters center to center and has been established by the Microtiter plate in which wells are arranged in a 8×12 rectangular pattern on 9 millimeter centers, well to well. Thus, the center to center spacing of the mounting shafts of all standard multi-channel pipettes is approximately 9 millimeters and the spacing between the centers of the holes in the support trays of all standard pipette tip racks is likewise approximately 9 millimeters. This insures that the center to center spacing of the open proximal ends of adjacent disposable pipette tips supported by all standard pipette tip racks will be approximately 9 millimeters and that side by side rack supported pipette tips will simultaneously receive and mate with the parallel mounting shafts of all standard multi-channel pipettes, as previously described.

After all pipette tips supported in a tip rack have been thus mounted on and removed from the tip rack, it is common practice to refill the tip rack with pipette tips for reuse rather than discarding the tip rack. To provide for such refilling of tip racks, pipette tip rack refill packs have been developed. Prominent among such refill packs are the GREEN-PAK and SPACESAVER refill packs of the Rainin Instrument Co., Inc., assignee of the present invention. Such refill packs are described in U.S. Pat. Nos. 5,392,914 and 5,441,702.

Basically, such refill packs comprise a vertically extending housing having an open bottom in which a horizontal support plate is releaseably secured. The support plate contains an array of holes matching the rectilinear array of holes in the support tray of standard pipette tip racks and supports an array of replacement pipette tips for simultaneous dispensing into the holes in the support tray of an empty pipette tip rack to refill the tip rack.

In the SPACESAVER refill pack, the housing supports several vertically separated horizontally extending carrier plates each having an array of holes matching the array of holes in the support tray of standard pipette tip racks and each supporting an array of replacement pipette tips. For compactness, the distal ends of vertically adjacent pipette tips in each array nest freely in the open proximal ends of the next lower array of pipette tips. A push plate is supported at an upper open end of the housing and allows a user to successively dispense arrays of pipette tips from the open bottom of the housing into a series of empty pipette tip racks simply by pushing downward on the push plate. Alternatively the user may periodically replenish the pipette tips in a single reusable tip rack.

The mounting and free nesting of pipette tips in tip racks and in refill packs as described above, while maintaining a 9 millimeter center to center spacing of the mounted tips is readily achieved for pipette tips of small and moderate volume, e.g. 10–300 microliters. However, currently, there is no large volume pipette tip, e.g. 500 microliters and above, which is mountable on 9 millimeter centers in standard tip racks and also freely nestable in refill packs for pipette tip racks. Specifically, the outer diameter of the proximal end portion of nearly all large volume pipette tips is greater than 9 millimeters. Thus, such large volume pipette tips are not mountable in a side by side array in standard tip racks. Examples of such pipette tips are the 1000 microliter Rainin RT 200, BioRad TBR-40, Continental Laboratory Products ESP1000 and the VWR Catalog No. 53508-991. The BioRad Corporation TBR-78, Catalog No. 223-9378, 1000 microliter tip includes an outer diameter less of than 9 millimeters. However, to reach a 1000 microliter internal volume the Bio Rad TBR-78 tip includes a cylindrical body portion which will not nest freely in similar pipette tips as required for use in refill packs. Similar, large volume pipette tips which are not freely nestable include the 500 microliter tips of Abbott Laboratories, the Abbott Catalog No. 3A46-54 and the Oxford Catalog No. 811. Thus, most large volume pipette tips require one at a time handling and mounting on the mounting shaft of large volume multi-channel pipette devices, a process which is slow and tedious and fraught with potential problems of tip and sample contamination.

A major factor contributing to the foregoing limitations associated with large volume pipette tips is the shape of the mounting shaft of large volume pipette devices. For small and moderate volume pipette devices, the outer diameter of the mounting shaft is substantially less than 9 millimeters, increasing in size as the volume capacity of the pipette device increases. For example, for standard 1000 microliter pipette devices, the outer diameter of the mounting shaft is approximately 7 millimeters. In order to seat firmly on such mounting shafts, the inner diameter of the proximal end portion of standard 1000 microliter pipette tip also is approximately 7 millimeters. As previously stated, this has resulted in the outer diameter of most 1000 microliter pipette tips being greater than 9 millimeters thereby preventing the side by side mounting of such 1000 microliter pipette tips in standard pipette tip racks having rectilinear arrays of holes on 9 millimeter centers. Those few 1000 microliter pipette tips that have an outer diameter of less than 9 millimeters are not designed to be freely nestable in pipette tip rack refill packs, as previously described.

Accordingly, there is a need for a new large volume pipette tip design which accommodates placement of large volume pipette tips in standard pipette tip racks as well as in standard refill packs for pipette tip racks, the large volume pipette tips being freely nestable within such refill packs. The present invention satisfies such needs.

SUMMARY OF THE INVENTION

As previously stated standard pipette tip racks basically comprise a base, vertically extending sides and a horizontally extending pipette tip support plate including a plurality of through holes arranged in a rectilinear (X,Y) array. For use in such standard tip racks the present invention provides a plurality of large maximized internal volume pipette tips each having a relatively thin wall substantially cylindrical proximal portion and an elongated generally conical distal portion coaxial with and joined to its proximal portion adjacent a downwardly facing shoulder extending outwardly from the tip. A tip end of the distal portion includes a relatively small orifice for receiving and dispensing fluid into and from the pipette tip upon operation of a pipette device to which the pipette tip is mounted. The shoulder may comprise the lower surface of vertically extending reinforcing ribs on an outer surface of the proximal portion or other circumferentially spaced outward projections from the tip. Preferably, however, the shoulder comprises a laterally extending annular shoulder. The proximal portion has an outer diameter equal to or slightly less than the center to center hole spacing in the pipette tip support tray of a standard tip rack and a slightly conical inner surface for tightly receiving and releaseably attaching to a pipette tip mounting shaft of a standard large volume pipette device. The distal portion of each pipette tip is designed to be vertically oriented in a different one of the through holes in the support tray with the shoulder on a top of the support tray for support thereby to form a first array of pipette tips supported by the pipette tip rack. Adjacent the shoulder, the distal portion of each pipette tip further includes substantially parallel inner and outer surfaces tapering slightly inward in a downward direction relative to a vertical longitudinal axis of the pipette tip to maximize the inner volume of the distal portion and for spacing slightly from an outer surface of a similar maximized volume pipette tip of a second array of the pipette tips which may freely nest in the first array of pipette tips.

As previously described, a standard pipette tip rack refill pack, such as the SPACESAVER, includes a vertically extending housing having an open bottom and a pipette tip support plate over the open bottom and a plurality of carrier plate within the housing above the support plate. The support plate and each carrier plate includes a matching plurality of through holes arranged in a rectilinear (X,Y) array. For use in such standard refill packs, the present invention provides at least a first and a second array of large maximized internal volume freely nestable pipette tips for mounting in the holes in the support plate and a carrier plate, respectively. Each tip has a relatively thin wall substantially cylindrical proximal portion and an elongated generally conical distal portion coaxial with and joined to its proximal portion adjacent a downwardly facing shoulder (as previously described) extending outwardly from the proximal portion of the tip. A tip end of the distal portion includes a relatively small orifice for receiving and dispensing fluid into and from the pipette tip upon operation of a pipette to which the tip is mounted. The proximal portion of each pipette tip has an outer diameter equal to or slightly less than the distance between the centers of adjacent through holes in the support plate and carrier plate and a slightly conical inner surface for tightly receiving and releasably attaching to a pipette tip mounting shaft of a large volume pipette. Adjacent the shoulder of each pipette tip in the first array, the inner and outer surfaces of the distal portion are substantially parallel and taper slightly inward in a downward direction relative to a vertical longitudinal axis of the tip. This maximizes the inner volume of the distal portion and provides for spacing between the inner surface and an outer surface of a similar pipette tip of the second array of pipette tips nesting in the first array of pipette tips. The distal portion of each pipette tip in the first array is vertically oriented in different one of the through holes in the support plate with its shoulder on a top of the support plate. The distal portion of each pipette tip in the second array is vertically oriented in a different one of the through holes in the carrier plate with its laterally extending shoulder on a top of the carrier plate. Further, the distal portion of each pipette tip in the second array extends into and nests in a pipette tip in the first array with the outer surface of the distal portion spaced slightly from the inner surface of the distal portion of the pipette tip into which it is nested.

The large volume freely nestable pipette tips of the present invention also are useful in pipette tip rack refill packs including a vertically extending housing having an open bottom and a support plate over the open bottom including a plurality of enlargeable through holes arranged in a rectilinear (X,Y) array. In such a refill pack the invention similarly comprises a first and a second array of large maximized internal volume freely nestable pipette tips. Each tip has a relatively thin wall substantially cylindrical proximal portion and an elongated generally conical distal portion coaxial with and joined to its proximal portion adjacent a downwardly facing shoulder (as previously described). An end of the distal portion of each pipette tip includes a relatively small orifice for receiving and dispensing fluid into and from the pipette tip upon operation of a pipette to which the tip is mounted. The proximal and distal portions of each pipette tip are the same as previously described. However, in such a refill pack the distal portion of each pipette in the first array is vertically oriented in a different one of enlargeable through holes in the support plate with its shoulder on a top of the support plate. The distal portion of each pipette tip in the second array is vertically oriented in an open proximal end of a different one of the tips in the first array with its shoulder bearing on a top of the tip in the first array into which the pipette tip is freely nested.

BRIEF DESCRIPTION OF THE DRAWINGS

FIG. 8*a* shows the refill pack of FIG. 5. FIG. 8*b* shows the refill pack of FIG. 5 positioned on an empty tip rack. FIG. 8*c* shows the refill pack of FIG. 5 with a lowermost array of replacement tips being dispensed into the tip rack.

DETAILED DESCRIPTION OF THE PREFERRED EMBODIMENTS

Figure 1:
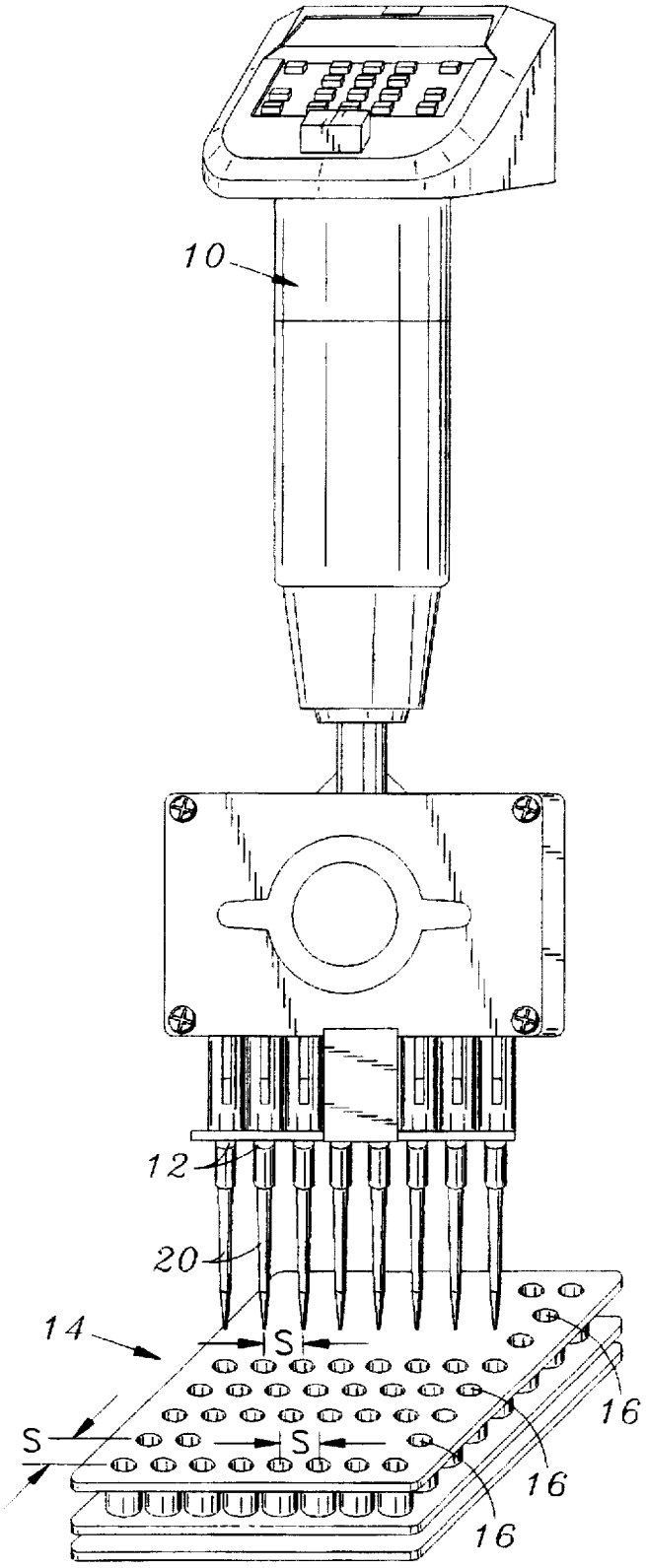
FIG. 1 is a perspective view of a standard multi-channel pipette device including eight parallel mounting shafts for mounting eight pipette tips. The axial center to center spacing of the mounting shafts is designated as "s" and equals the center to center spacing of the wells in a standard titer plate shown below the pipette device.

As previously indicated, the spacing of pipette tips in standard pipette tip racks is critical for the seating of the pipette tips on the mounting shafts of multi-channel pipette devices. Further, the spacing of the mounting shafts of multi-channel pipette devices is controlled by the center to center spacing of the wells of the receptacle into which fluid is to be dispensed by the multi-channel pipette. The industry standard for such well spacing is approximately 9 millimeters center to center and has been established by the Microtiter plate in which wells are arranged in an 8 by 12 rectangular pattern on 9 millimeter centers, well to well. FIG. 1 illustrates such a standard multi-channel pipette device 10 including a plurality of vertically oriented, parallel, spaced mounting shafts 12 (e.g. 8) mounting a plurality of pipette tips 20, according to the present invention, and positioned over a standard Microtiter plate 14. As illustrated, the Microtiter plate 14 includes an array of wells 16 arranged in an 8 ×12 rectilinear pattern on 9 millimeter centers well to well indicated by the letter "s". Also, as indicated, to provide for the dispensing of measured quantities of sample fluid into the well 16, the pipette tips 20 are spaced at their distal ends the distance "s" which is the distance between the axial center lines of the mounting shafts 12 of the multi-channel pipette 10.

Figure 2:
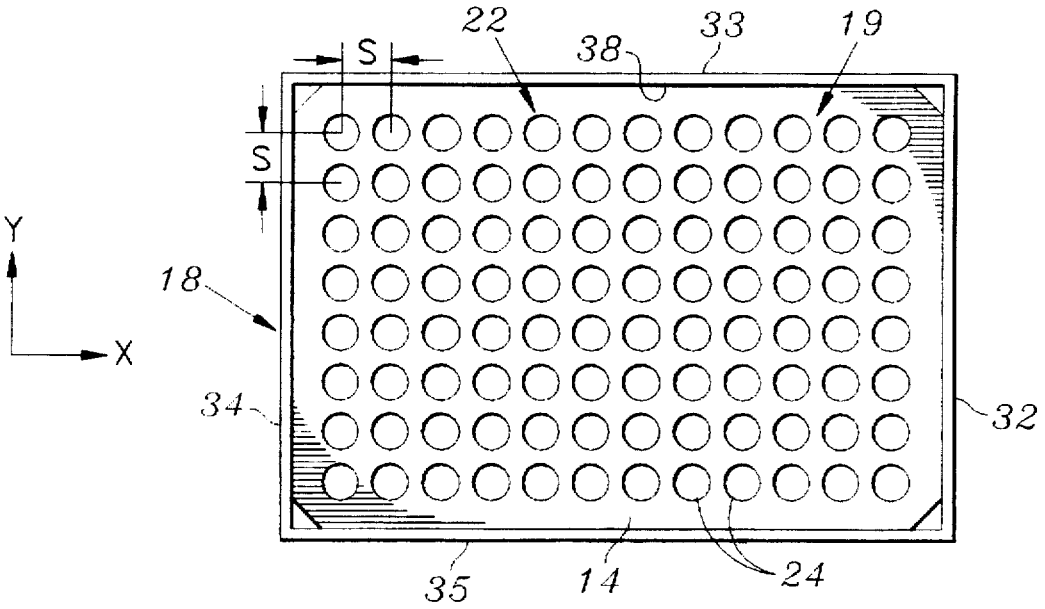
FIG. 2 is a top view of a standard tip rack showing the support tray of the rack including a plurality of through holes arranged in an 8 by 12 rectilinear (X,Y) array with the holes being spaced on 9 millimeter centers.

Further, as illustrated in FIG. 2 for a standard pipette tip rack 18, the tip rack includes the pipette tip support tray 19 including an array 22 of holes 24 spaced in a rectilinear (X,Y) pattern each spaced a distance "s" in X and Y directions equal to the center to center spacing of the wells 16 and the spacing between the central axes of the mounting shafts 12 of the pipette 10. In standard pipette tip racks, such spacing is approximately 9 millimeters in the X and Y direction.

As also previously mentioned, similar spacing of holes in support and carrier plates is provided in standard refill packs for pipette tip racks which are intended to house stacked arrays of pipette tips telescoping and nesting freely for compact packaging and dispensing into empty pipette tip racks.

While the mounting of replacement pipette tips in standard pipette tip racks and the mounting and free nesting of pipette tips in standard refill packs for pipette tip racks is readily achieved for pipette tips of small or moderate volume, currently there is no large volume pipette tip, e.g. 500 microliters and above, which is mountable on 9 millimeter centers in standard tip racks and also freely nestable in standard refill packs for pipette tip racks.

Figure 3A:
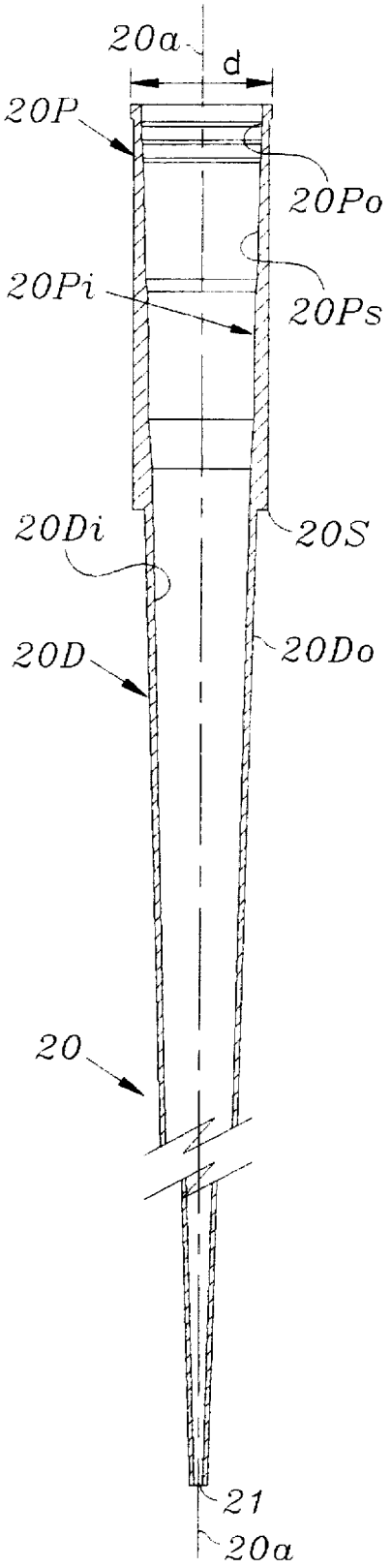
FIG. 3A is an enlarged cross-sectional side view of a large, maximized internal volume, freely nestable pipette tip according to the present invention.

In satisfying the need for such large volume freely nestable pipette tips, the present invention comprises a new design as shown in FIG. 3A. As illustrated, the improved large maximized internal volume freely nestable pipette tip is designated by the number 20 and comprises a substantially cylindrical proximal portion 20P and an elongated generally conical distal portion 20D coaxial with and joined to the proximal portion adjacent a downwardly facing shoulder 20S. The shoulder 20S may be formed by the bottoms surface of a plurality of vertical reinforcing ribs on the outer surface of the proximal portion 20P or by a plurality of circumferentially spaced outward projections from the tip. Preferably, the shoulder 20S comprises a laterally extending annular shoulder. A tip end of distal portion 20D includes a relatively small orifice 21 for receiving and dispensing fluid into and from the pipette tip 20 upon operation of the pipette device to which the pipette tip is mounted, such as the pipette 10 of FIG. 1.

The proximal portion 20P of the pipette tip 20 has an outer diameter "d" equal to or slightly less than the center to center spacing "s" {e.g. 85–100% of "s") of immediately adjacent through holes 24 in the pipette tip rack support plate 19 as depicted in FIG. 2 and the mounting shaft and well spacings depicted in FIG. 1. Further, the proximal portion 20P of each pipette tip 20 includes a slightly conical inner surface 20Pi sloping slightly inward from a thin wall open end 20P$_o$ of the proximal portion to a slightly conical sealing region 20P$_s$ dimensioned to tightly receive and releaseably attach the pipette tip 20 to a pipette mounting shaft such as one of the mounting shafts 12 of the standard multi-channel pipette device shown in FIG. 1.

Adjacent the shoulder 20S, the distal portion 20D of each pipette tip 20 includes substantially parallel inner and outer surfaces 20Di and 20Do tapering slightly inward in a downward direction relative to a vertical longitudinal axis **20*a* of the pipette tip. Such shaping of the distal portion 20D** maximizes the inner volume of the distal portion 20D while such shaping in the region adjacent the shoulder 20S provides for a free nesting of pipette tips 20 when axially telescoped as in a standard tip rack refill pack. More particularly, such shaping provides a spacing of the inner surface 20Di of a first pipette tip 20 from an outer surface 20Do of a second pipette tip 20 when the second pipette tip is telescoped into the first pipette tip. In particular, the inner surface 20Di of a first pipette tip 20 is laterally separated or spaced from an outer surface 20Do of a second pipette tip 20 when the second pipette tip 20 is telescoped into the first pipette tip. This will be described in greater detail in connection with FIGS. 5, 7*a* and 7*b*.

Preferably, for the large maximized internal volume freely nestable pipette tip 20 of FIG. 3A, the tip has an overall length in a range of 4.5 and 14.5 centimeters, preferably 8.6 centimeters, while the proximal portion 20P has a length in a range of 1.5 and 4.0 centimeters and the distal portion 20D has a length in a range of 3.0 to 10.5 centimeters. The preferred lengths of the proximal and distal portions 20P and 20D are 2.6 and 6.0 centimeters, respectively. Preferably, the inner diameter of the proximal portion 20P is in a range of 6.5 to 8.5 millimeters at its proximal end, preferably 7.7 millimeters. As illustrated, the inner surface 2OPi tapers inwardly at an angle in a range of 0 to 5 degrees from the vertical axis 20*a*, preferably 1.5 degrees. Accordingly, at the distal end of the proximal portion 20P, the inner diameter of the inner surface 20Pi is in a range of 3.5 to 7.2 millimeters, preferably 6.1 millimeters. This corresponds to the range and preferred inner diameters of the inner surface 20Di at its proximal end. As previously indicated, the inner and outer surfaces 20Di and 20Do taper inwardly relative to the axis 20*a*. That taper preferably is in a range of 1.3 to 2.0 degrees, preferably 1.456 degrees. At the distal tip of the distal portion 20D, the orifice 21 preferably has an inner diameter in a range of 0.4 to 2.0 millimeters, preferably 0.75 millimeters.

Figure 3B:
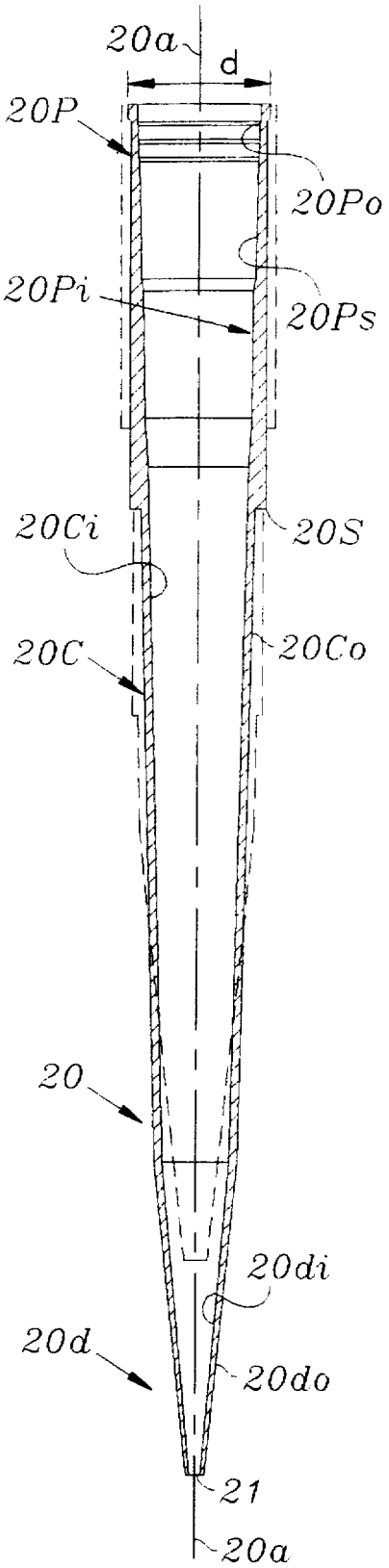
FIG. 3B is an enlarged cross-sectional side view of a preferred version of a 1000 microliter, maximized internal volume pipette tip according to the present invention shown overlaying a standard 1000 microliter pipette tip and illustrating the structural differences therebetween.

While the pipette tip 20 may comprise only the proximal and distal portions 20P and 20D (as illustrated in FIG. 3A.), it may be desired to shorten the overall length of the pipette tip in the manner illustrated in FIG. 3B. In particular, FIG. 3B illustrates in solid cross-section a preferred embodiment of a 1000 microliter, maximized internal volume pipette tip according to the present invention and in dashed outline, for purposes of comparison, a standard 1000 microliter pipette tip. In that regard, the distal portion 20D includes two contiguous sections, a central portion 20C and a distal end portion 20*d*. The central portion 20C is substantially frustoconical in shape and comprises the upper section of the distal portion 20D while the distal end portion 20*d* is cone shaped and is coaxial with and extends downward from the distal end of the central portion 20C.

Preferably, the outer surface 20do of the distal end portion 20*d* of each pipette tip 20 tapers at a slightly greater angle than the inner surface 20di of the distal end portion to define a side wall of narrowing thickness adjacent the orifice 21.

Preferably, for the 1000 microliter pipette tip 20 shown in FIG. 3B, the shape and dimensions of the proximal portion 20P are the same as the tip shown in FIG. 3A while the central portion 20C and the distal end portion 20*d* of the pipette tip of FIG. 3B have a combined internal volume of at least 1000 microliters. Further, the overall length of such a 1000 microliter pipette tip is in a range of 6.5 to 12.0 centimeters, preferably 8.6 centimeters while the inner diameter at its proximal end is approximately 7.7 millimeters and the inner diameter at its distal end is approximately .75 millimeters.

For the preferred 1000 microliter pipette tip shown in FIG. 3B, the central portion 20C has a length of approximately 4 centimeters while the inner and outer surfaces of the central portion 20C have a rate of taper in a range of approximately 1.3 to 2.0 degrees from the vertical axis 20*a* of the pipette tip, preferably 1.456 degrees.

Moreover, the distal end portion 20*d* preferably has a length of approximately 2.0 centimeters, while, the outer surface 20*do* of the distal end portion preferably has a rate of taper in a range of approximately 1.3 to 7 degrees relative to the vertical longitudinal axis 20*a* of the pipette tip, preferably 5.6 degrees, and the inner surface 20*di* of the distal end portion preferably has a rate of taper of approximately 1.3 to 7 degrees from the vertical longitudinal axis 20*a*, preferably 4.72 degrees.

Figure 4:
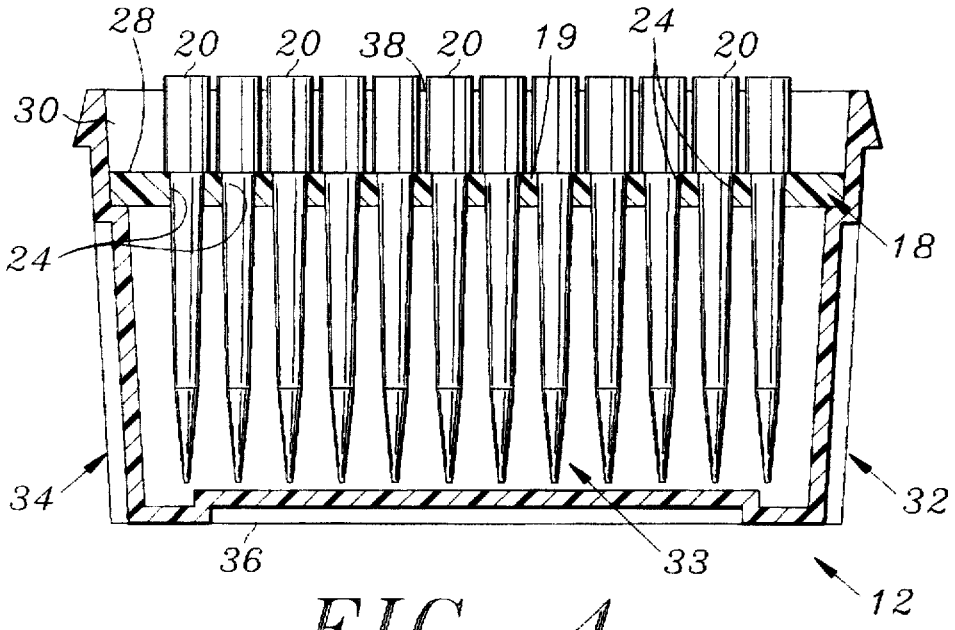
FIG. 4 is a slightly enlarged sectional side view of the tip rack of FIG. 2 showing a plurality of tips of the present invention (FIG. 3B) mounted in the tip rack.

A first preferred embodiment of the present invention comprises a combination of a plurality of the pipette tips 20 (FIG. 3A or FIG. 3B) in a standard tip rack. As shown in FIGS. 2 and 4 the standard pipette tip rack 18 for receiving a plurality of large maximized volume pipette tips 20 of the present invention preferably includes vertically extending contiguous side members 32, 33, 34 and 35, secured to define a rack in the form of a housing having a closed bottom 36, closed sides and an open top 38 tightly receiving the support tray 19 for an array of the pipette tips 20. In this regard, the support tray 19 is tightly supported on a shoulder in the side members 32, 33, 34 and 35 with the array of holes 24 in the support tray designed to receive the distal end and central portions 20C and 20*d* of an array of pipette tips 20 (FIG. 3B) as shown in FIG. 4. In particular, when positioned in the tip rack 12, the central portion 20C of each pipette tip 20 is vertically oriented in a different one of the through holes 24 in the support tray 19 with its laterally extending shoulder 20S on a top of the support tray for support thereby to form a rectilinear (X,Y) array of pipette tips supported by the rack 12. In order to allow for such support with the proximal end portions 20P of each pipette tip spaced slightly from its neighbor, it is important that the outer diameter of the proximal end portion 20P of each pipette tip be equal to or preferably slightly less than "s" (e.g. 85–100% "s").

A second preferred embodiment of the present invention possessing all of the foregoing features comprises a combination including a standard pipette tip rack refill pack and several arrays 42–48 of pipette tips 20 (FIG. 3A or FIG. 3B). Such a refill pack 40 for nested multiple arrays of pipette tips 20 (FIG. 3B) is shown in FIGS. 5, 7*a*, 7*b* and 8*a*–8*c*. More particularly, the refill pack 40 is described in detail as refill pack 70 in U.S. Pat. No. 5,392,914. Basically, the refill pack 40 comprises (1) a support plate 50 with an array of holes 52 vertically supporting the array 42 of pipette tips 20, (2) a vertically extending tubular housing 54 for confining the support plate 50 across a lower open end of the housing and confining the arrays 42–48 of pipette tips 20 above the support plate, (3) a push plate 56 in an open top of the housing 54 and (4) flexible resident flaps 58 bounding the holes 52 for releasably securing the proximal end portion 20P of the pipette tips 20 of the array 42 in the holes in the support plate 50 (see FIG. 6). Upon a user application of a downward force on the push plate 56, the nested arrays 42–48 are forced downward within the housing 54 causing the flaps 58 to flex downwardly to enlarge the openings of the holes 50 and allow the lowermost array 42 of pipette tips 20 to drop vertically from the open bottom of the housing 54 into an empty pipette tip rack located under the housing. In this regard, and as most clearly shown in FIG. 7*a*, the lower open end of the housing 54 forms an open bottom skirt 60 which is dimensioned to guide and center the housing over an organizing tray 62 of an empty pipette tip rack 64 with distal ends of the lowermost array 42 of tips 20 aligned with corresponding holes in the tray to provide vertical support for the tips as they drop into the organizing tray.

Figure 8A:
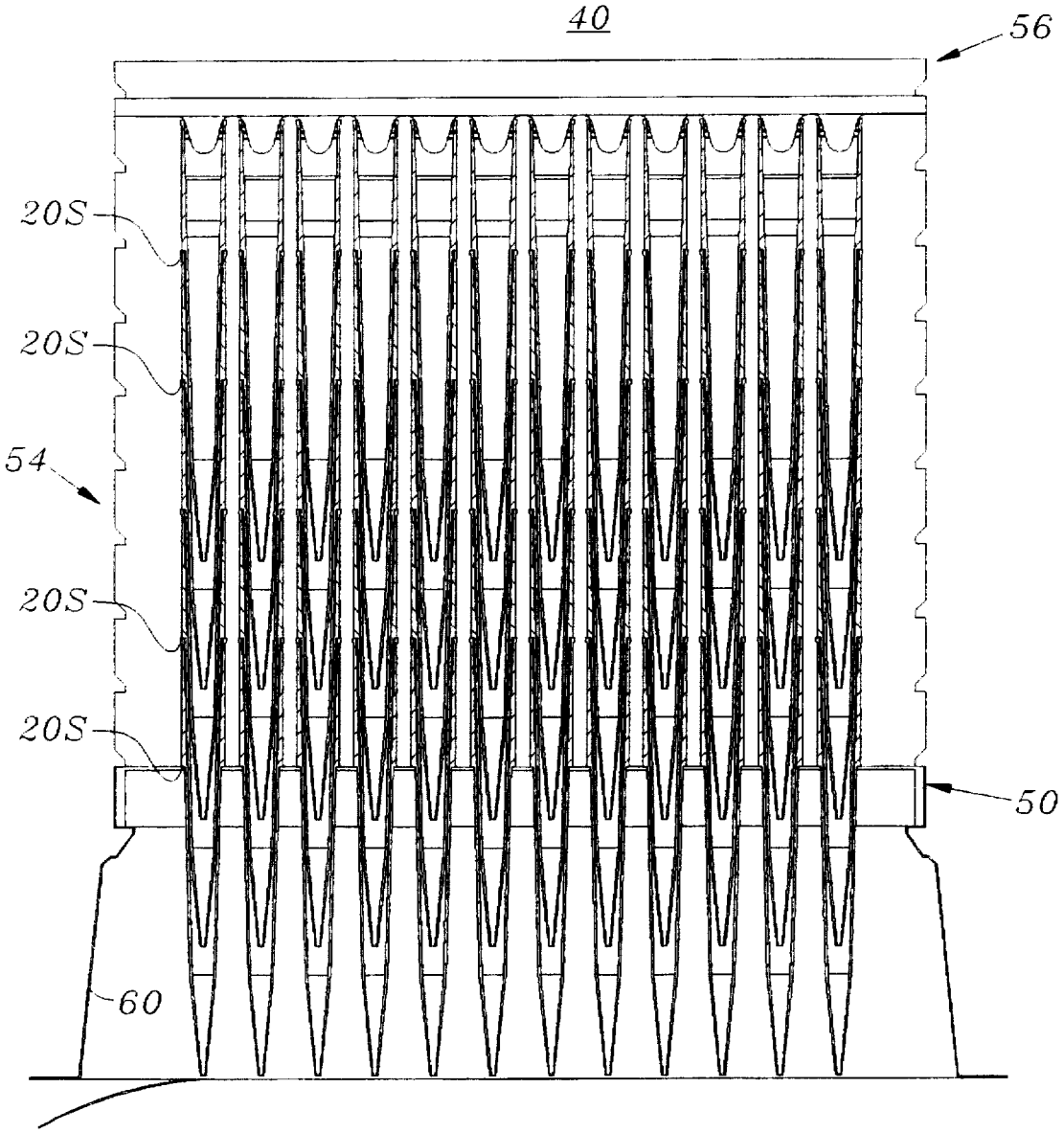
FIGS. 8*a*, 8*b* and 8*c* depict the refill pack of FIG. 5 and the process of refilling an empty tip rack with a replacement array of pipette tips from the refill pack.
Figure 8B:
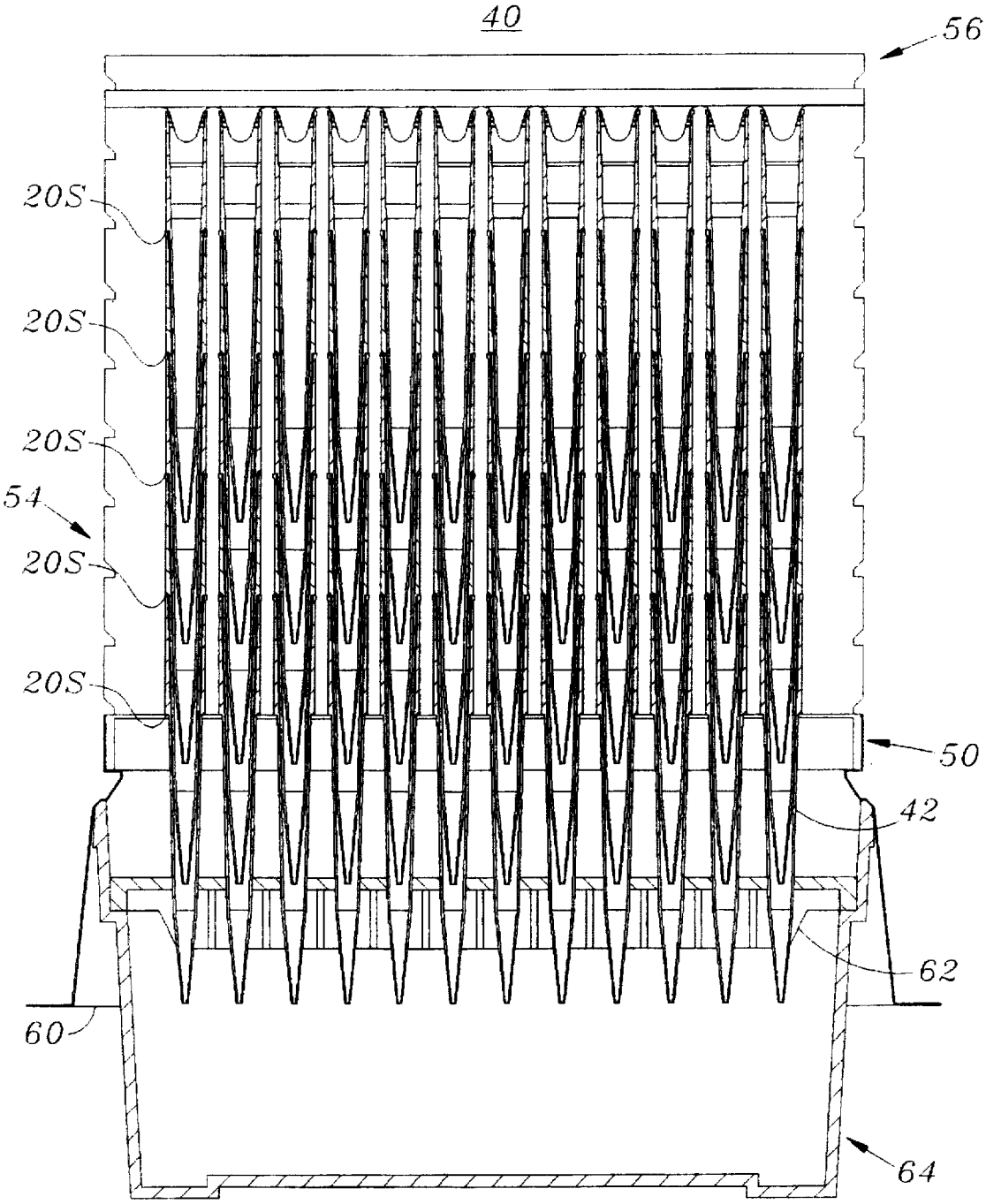
Figure 8C:
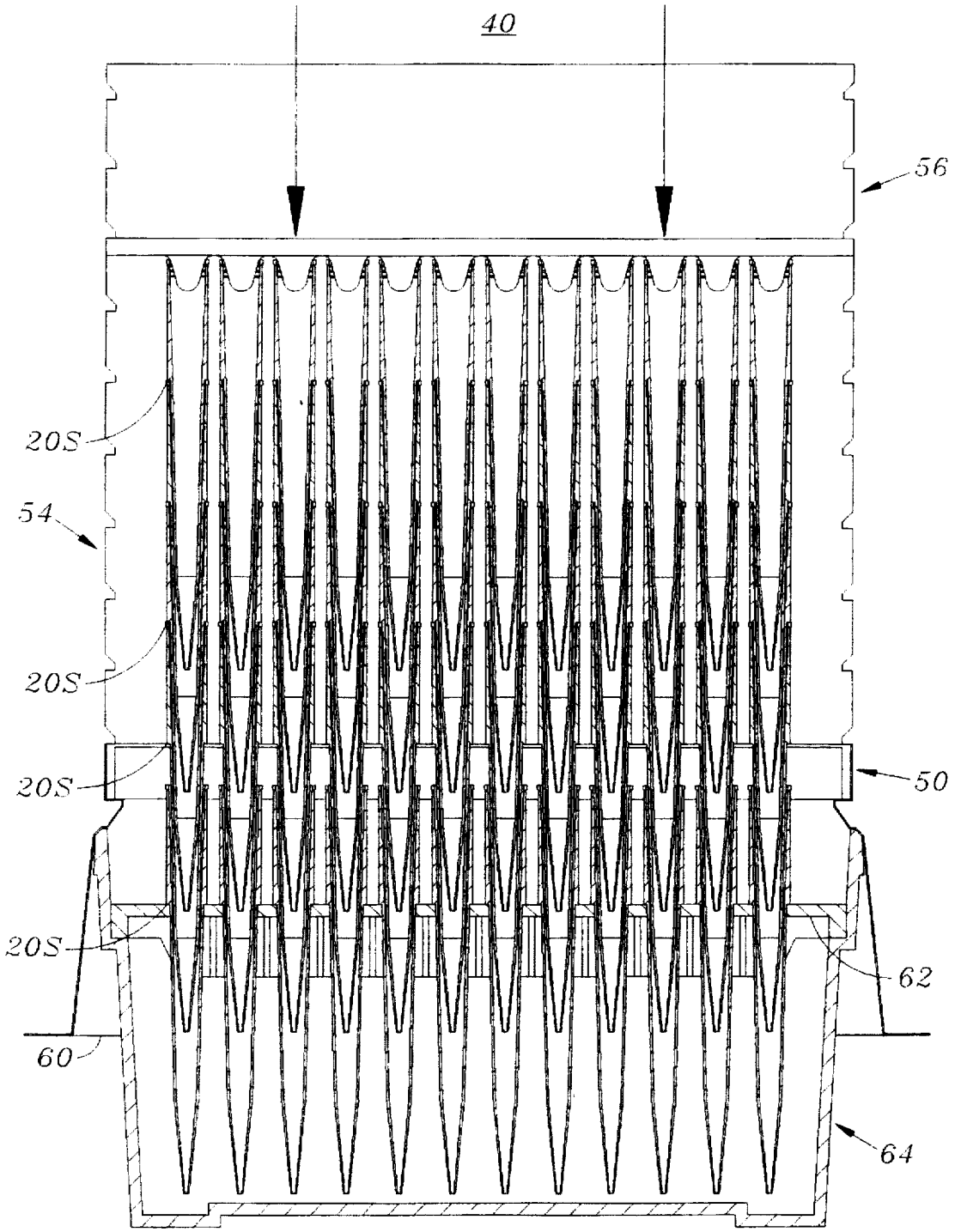

The foregoing sequence of use of the refill pack 40 in reloading the tip rack 64 is depicted in FIGS. 8*a*–8*c*. FIG. 8*a* depicts the refill pack 40 as stored ready for use. FIG. 8*b* depicts the refill pack 40 over the tip rack 64 with the skirt 60 guiding and centering the refill pack onto the rack with the distal end portions of the lowermost array 42 of pipette tips 20 aligned with and entering the array of holes 52 in the organizing tray 62. FIG. 8*c* depicts the dispensing of the lowermost array 42 of pipette tips 20 from the refill pack 40 in response to a downward manual movement of the push plate 56.

Figure 5:
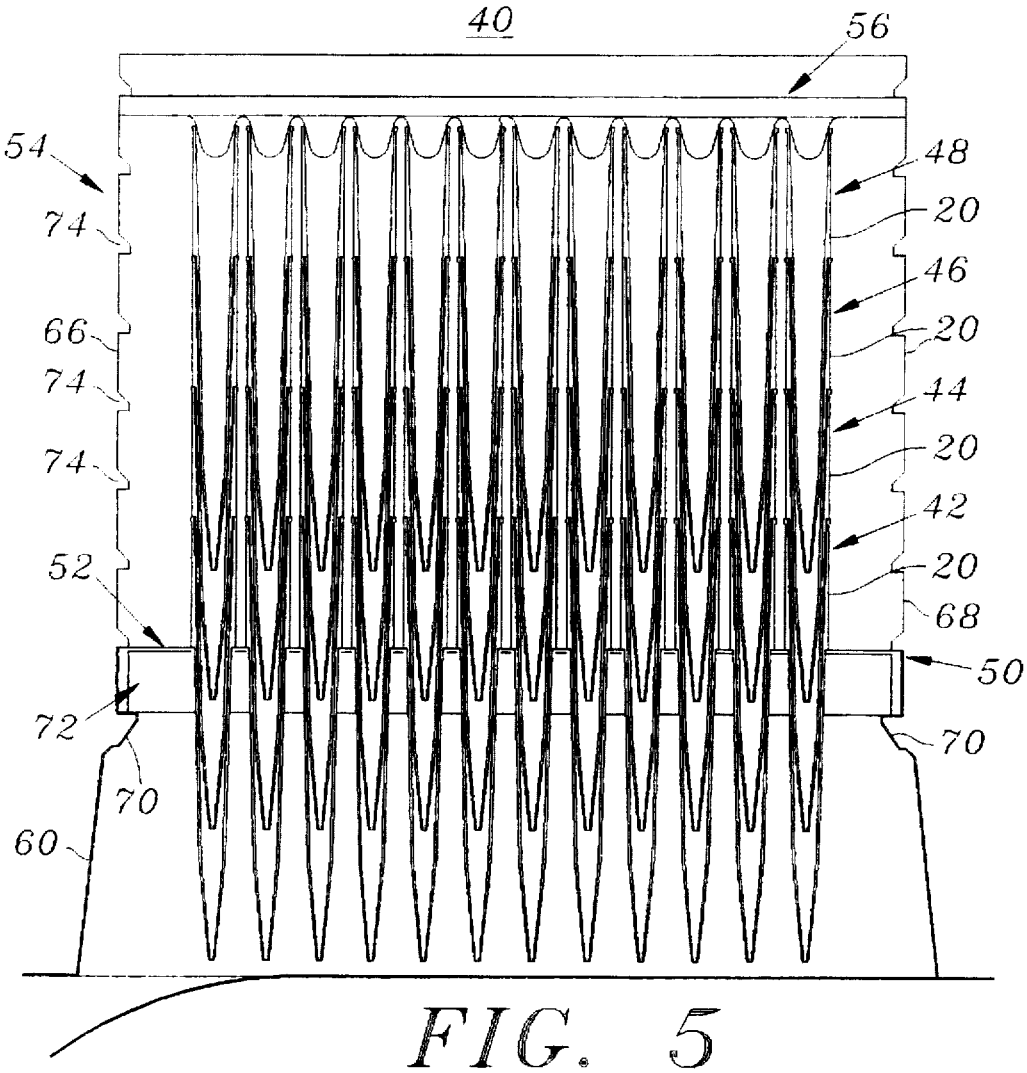
FIG. 5 is a side view of a transparent plastic multiple pipette tip array refill pack showing a first array of pipette tips of the present invention (FIG. 3B) positioned in a support plate and four vertically stacked arrays of such pipette tips each nesting freely in the next lower array of tips.
Figure 7A:
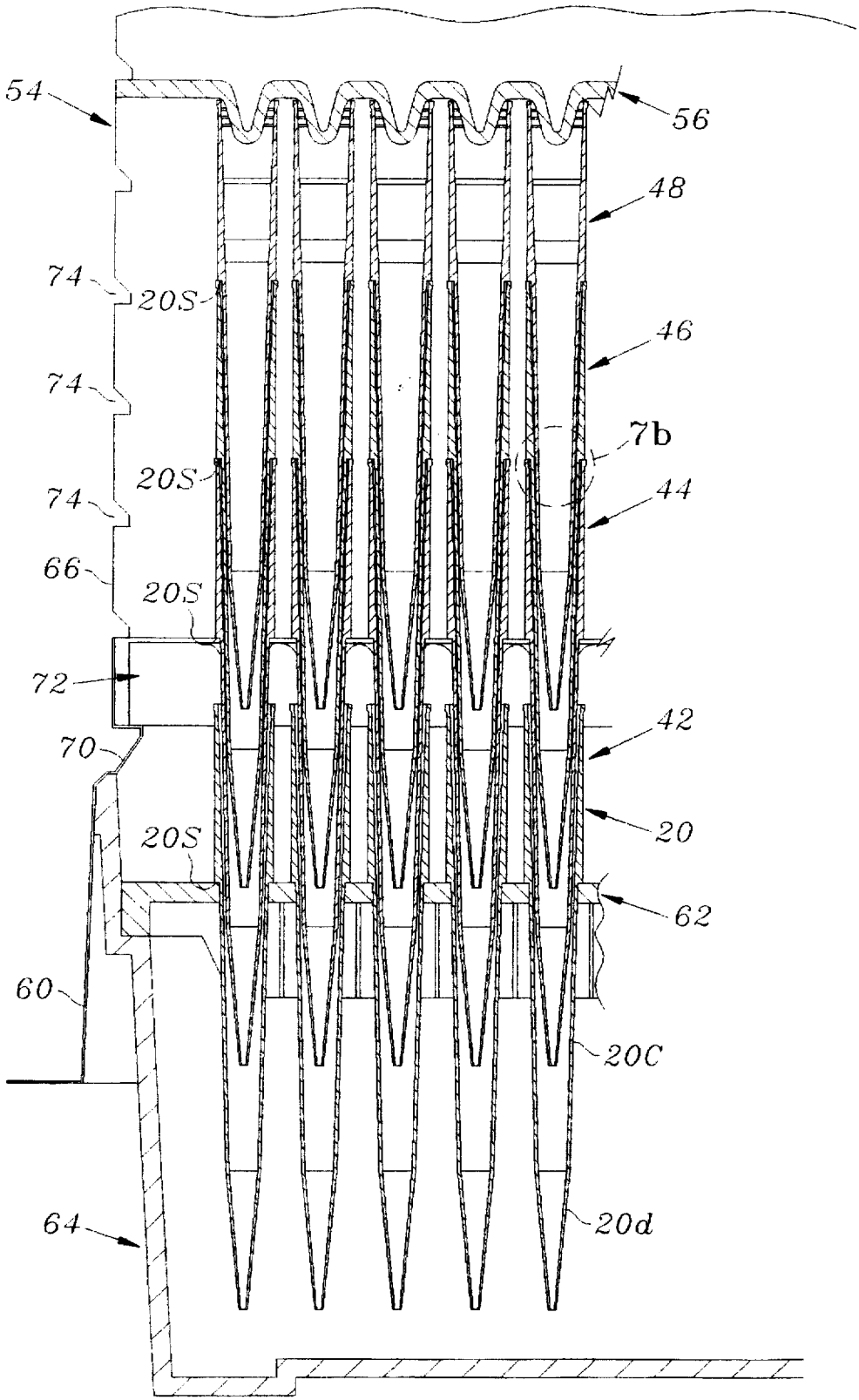
FIG. 7*a* is an enlarged partial side view of the refill pack of FIG. 5 partially in section and positioned on a tip rack.

More particularly, as most clearly shown in FIGS. 5 and 7*a*, the refill pack 40 vertically separates arrays 42, 44, 46 and 48 of horizontally spaced pipette tips 20 telescopically stacked within the pack with distal end portions 20*d* of pipette tips 20 in the lowermost array 42 extending downward through the holes 52 in the horizontally oriented support plate 50. The distal end portions 20*d* of the pipette tips 20 in the next lowermost array 44 telescope into the proximal end and central portions 20P and 20C of the pipette tips 20 in the array 42 while distal end and central portions 20*d* and 20C of the pipette tips 20 in the array 46 telescope into the proximal end and central portions 20P and 20C of the pipette tips 20 in the array 44 and so on up to the array 48, all as shown in FIGS. 5 and 7*a*.

Figure 7B:
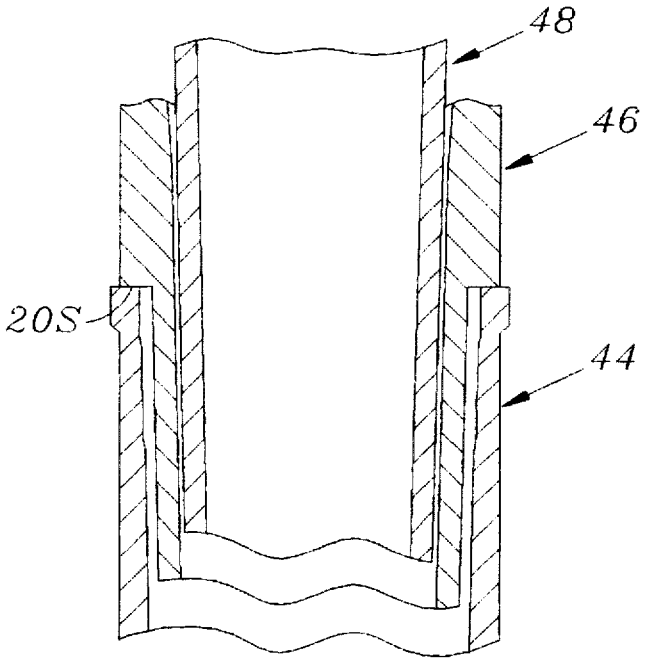
FIG.7*b* is an enlarged fragmentary sectional side view of the portion 7*b* depicted in FIG. 7*a*.

As depicted most clearly in FIGS. 7*a* and 7*b*, each pipette tip 20 in each of the arrays 44, 46 and 48 nests freely in the tips into which they telescope in arrays 42, 44 and 46, respectively. Such free nesting of the tips 20 is provided by the shoulders 20S of the tips 20 in array 44 engaging and resting on the top of the proximal end 20P of the tips 20 in the array 42 and by the taper of the central portions 20C of the tips in the arrays 42 and 44 which provide a lateral spacing and separation of the outer surfaces 20Co of the tips in array 44 from the inner surfaces 20Ci of the tips in array 42. Similarly, the shoulders 20S of the pipette tips 20 in the array 46 rest on the tops of the proximal ends 20P of the tips in the array 44 and the central portions 20C of the tips in the array 46 nest freely in the proximal and central portions of the pipette tips in array 44. The same free nesting is associated with the tips 20 of array 48 nesting in the tips 20 of array 46.

Further as to the refill pack 40, the proximal end portions 20P of the pipette tips 20 of array 48 engage the push plate 56 within the four sided tubular housing 54. The housing 54 preferably is formed of a light weight plastic and is dimensioned to receive and capture the horizontal support plate 50 at the lower open end of the housing and to receive the push plate 56 at the upper open end of the housing. Opposing sides 66 and 68 of the tubular housing 54 are essentially rectangular, parallel, vertically oriented and mutually attached at contiguous edges thereby enclosing an essentially rectangular volume. The sides 66 and 68 include vertically spaced and horizontally extending inward projections 70 positioned to constrain and position the support plate 50 with marginal edges within a channel 72 adjacent to the lower opening of the housing 54. Thus positioned, the support plate 50 places the pipette tips 20 of the lowermost array 42 with distal end portions 20*d* of the pipette tips extending downward through the array of holes 52 in the support plate for protection within the lower end of the housing 54. Additional inward projections 74 in the sides 66 and 68 of the housing 54, comprise horizontally separated, vertical series of triangularly shaped ramps, spaced at equal intervals vertically above the support plate 50 to permit downward incremental movement of the push plate 56 and prevent an upward return movement. The distance of the downward incremental movement of the push plate 56 thereby affects a sequential releasing of the lowermost one of the arrays 42, 44, 46 and 48 of pipette tips 20 through the enlargeable holes 52 in the support plate 50 into the holes in a tray 62 in the pipette tip rack 64 and a positioning of the distal end portions 20*d* of the next lowermost array of pipette tips in the enlargeable holes 52 for subsequent release.

As shown in FIG. 7*a*, the sides 66 and 68 also form the skirt 60 at the lower open end of the housing 54 for positioning the refill pack 40 over the tip rack 64 with the distal end portions 20D of the array 42 of pipette tips 20 extending downward therein and aligned with holes in the tray 62 in the tip rack 64 as depicted by the sequence of FIGS. 8*a*–8*c*.

Figure 6:
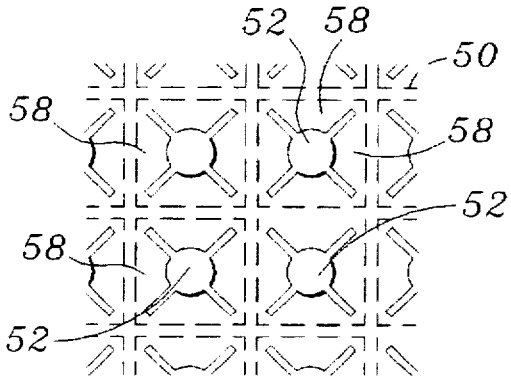
FIG. 6 is an enlarged partial top view of a punched sheet forming variable size holes for control of the release of nested pipette tips from the refill pack shown in FIG. 5.

More particularly, as to the sequential release of the arrays 42, 44, 46 and 48 of pipette tips from the housing 54, such release is the result of combined interaction of the push plate 56, the projections 74 and the enlargeable opening 52. In that regard, and as depicted in FIGS. 6 and 7*a*, the series of inward projections 74 successively engage the push plate 56 with downward movement of the plate. As the plate moves downward, the arrays of the tips are forced downward, the lowermost array causing the flaps 58 to flex downward to enlarge the openings 52 to pass the proximal end portions 20P of the lowermost array 42 of pipette tips 20 and to dispense the array 42 into the tip rack 64. Following the passage and release of the proximal end portions 20P of the tips in the array 42, the flaps 58 extending into each hole 52 return to their smaller dimension to accept the distal end portions 20P of the next lowermost array 44 of pipette tips 20 as they descend into a dispensing position. The foregoing dispensing operation may then be repeated for the array 44 and so on until all of the arrays of pipette tips are dispensed by the refill pack into pipette tip racks.

Figure 10:
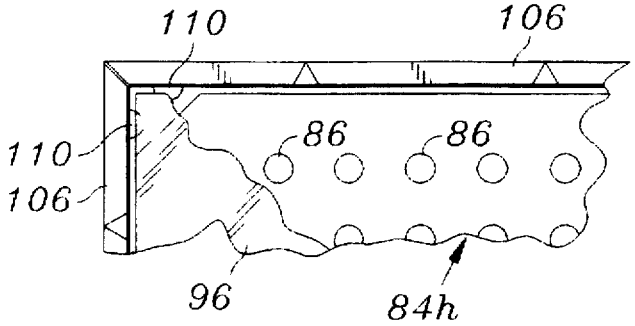
FIG. 10 is a top view partially cut away of a corner of a push plate and an upper carrier plate in the SPACESAVER refill shown in FIG. 9.
Figure 9:
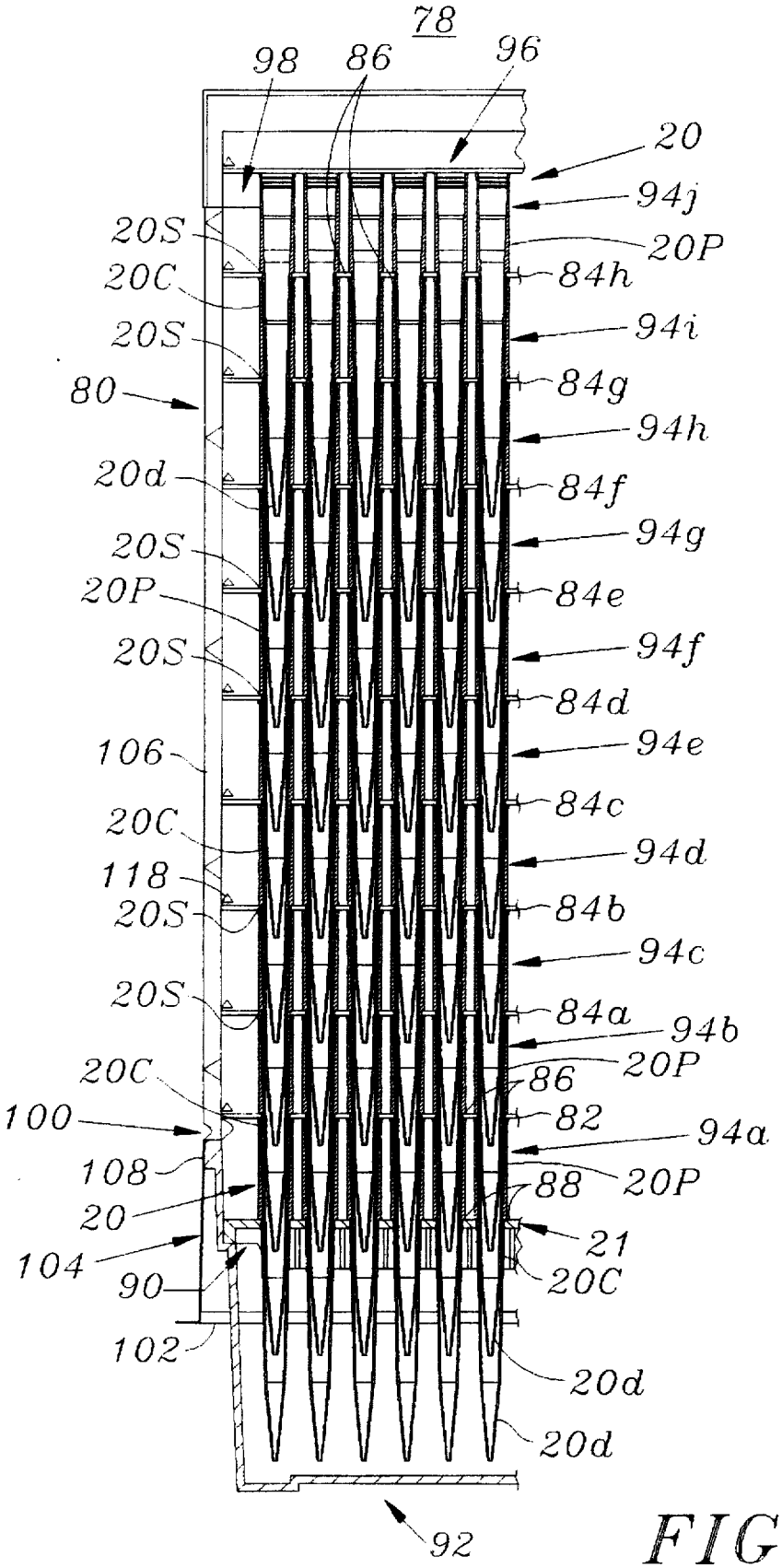
FIG. 9 is a partial side view of a standard SPACESAVER refill pack with multiple arrays of pipette tips of the present invention (FIG. 3B) positioned in support and carrier plates of the refill pack.

A third preferred embodiment of the present invention comprises the stacked multiple pipette array refill pack 78 shown in FIGS. 9 and 10 and described in detail as pack 130 in U.S. Pat. No. 5,392,914. Generally speaking, the refill pack 78 resembles the refill pack 40 of FIGS. 5–8*c* and comprises a vertical tubular container 80 for containing arrays of the large maximized internal volume freely nestable pipette tips (FIG. 3A or FIG. 3B). As illustrated, the container 80 may be formed of a thin light weight plastic material and houses a pipette tip organizing and support plate 82 and eight (8) carrier plates 84*a*–*h*, each with an identical array of holes 86 corresponding to the array of holes 88 in the organizing tray 90 of a tip rack 92 upon which the refill pack 78 is positioned. The organizing tray, the support plate and each carrier plate supports a different array 94*a*–*j* of pipette tips 20 (FIG. 3B). The refill pack 78 also includes a push plate 96 positioned in an open upper end 98 of the container 80 and release structure 100 releasably securing the support plate within the container over a lower open end 102 thereof.

In addition, a lower annular portion of the container 80 forms a skirt 104 for positioning and guiding the container over and onto the tip rack 92. As shown in FIG. 9, when the container 80 is positioned over the tip rack 92, the central and distal end portions 20C and 20*d* of a lowermost array 94*b* of pipette tips 20 confined in the container extend into corresponding holes 88 in the organizing tray 90 and nest freely in proximal end portions of corresponding ones of the tips 20 in the array 94*a* in the fully loaded tip rack 92. The tip rack 92 is banded to the container 80 by a removable plastic sleeve (not shown) to complete a ready-for-shipment package.

When it is desired to use the pipette tips 20 in the tip rack 92, the band is removed to separate the container 80 from the tip rack. The array 94*a* of pipette tips 20 in the tip rack 92 are then dispensed from the rack in a conventional manner. When the array 94*a* of pipette tips has been dispensed from the rack, the container 80 is then nested over the now empty tip rack 92. When so positioned, actuation of the release structure 100, as by the execution of a downward force on the push plate 96, releases the support plate 82 and its array 94*b* of pipette tips 20 into the tip tray 90 thereby refilling the pipette tip rack 92. Once the rack 92 has dispensed the array 94*b* onto single or multiple-channel pipettes, the foregoing operation may be repeated to again refill the rack 92 with the next lowermost array 94*c* of pipette tips 20, and so on. In the dispensing of pipette tips from the tip rack 92, structural support for the carrier plates 84 is provided by the tip rack 92. For that reason, the support plate 82 and carrier plates 84 may be formed of a thin light weight semi-rigid plastic material which upon disposal represents a minimum of non-biodegradable waste.

More particularly as shown in FIG. 10, the support plate 82 and each of the plurality of horizontally oriented carrier plates 84*a–h*, has an array of holes 86 corresponding to the array of holes 88 in the organizing tray 90 of the tip rack 92. As shown in FIG. 9, each hole 86 receives the central portion 20C and distal end portion 20*d* of a pipette tip 20 which extends vertically downward therethrough with the proximal end portion 20P of the tip extending vertically upward therefrom. Thus, the support plate 82 and carrier plates 84*a–h* position the arrays 94*b–j* of pipette tips 20 with the longitudinal axis of each pipette tip 20 in a vertical orientation. The plurality of carrier plates 84*a–h* are stacked in the container 80 with the central and distal end portions 20C and 20D of pipette tips 20 of the array 94*j* in the uppermost carrier plate 84*h* nesting freely in the proximal end and central portions 20P and 20C of pipette tips 20 of the array 94*i* supported by the next lower carrier plate 84*g* and so on down to the lowermost carrier plate 84*a* and the support plate 82. In such a nesting arrangement for the pipette tips, the upper carrier plate 84*h* rests on top of the proximal end portions 20P of pipette tips 20 of the array 94*i* in the carrier plate 84*g* while the carrier plate 84*g* rests on top of the proximal end portions of the pipette tips 20 of the array 94*h* in the carrier plate 84*f* and so on down to the lowermost carrier plate 84*a* and support plate 82 which is supported by the release structure 100 to releaseably retain the support plate in the container 80.

Further, as previously described and as shown in FIG. 9, each pipette tip 20 in each of the arrays 94*b–j* nests freely in a tip of the next lower array. Such free nesting of the tips is provided by the shoulders 20S of the tips 20 in the array 94*b* engaging and resting on the top of the support plate 82 and by the taper of the central portions 20C of the tips in arrays 94*b* and 94*a* which provide a lateral spacing and separation of the outer surfaces 20Co of the tips in array 94*b* from the inner surfaces 20Ci of the tips in the array 94*a*. Similarly, the shoulders 20S of the pipette tips 20 in the array 94*c* rest on the top of the carrier plate 84*a* and the central portions 20C of the tips in the array 94*c* nest freely in the proximal and central portions of the pipette tips in the array 94*b*. The same free nesting is associated with the tips 20 of each of the arrays 94*c–j*.

As illustrated, in FIG. 9, the push plate 96 resides in the open upper end 98 of the container 80 and rests on the proximal end portions 20P of the pipette tips 20 in the array 94*j*. When external downward force is applied to the push plate 96, it moves downward pressing against the uppermost array 94*j* of pipette tips 20 to transmit the force through the arrays 94*c–i* to the lowermost array 94*b*. Each carrier plate 84*a–h* sequentially moves downward, in turn assuming the position of the support plate 82, and is ejected by action of the indexed downward movement of the push plate 96 against the proximal end portion 20P of the array 94*i* of pipette tips 20 within the refill pack 78.

In the refill pack 78, the release structure 100 is part of the four sided tubular container 80. As shown, the container 80 is dimensioned (i) to receive, support and transport the horizontal carrier plates 84*a–h*, each sequentially into position as the support plate 82 above the lower open end 102 of the container and (ii) to receive the push plate 96 at the open upper end 98. Opposing sides 106 of the tubular container 80 are essentially rectangular, parallel, vertically oriented and mutually attached at contiguous edges thereby enclosing an essentially rectangular volume. The sides 106 include vertically positioned and horizontally extending inward projections 108 for releasably supporting and positioning the support plate 82 marginal edges within the lower opening end 102 of the container 80. Thus positioned, the support plate 82 places the central and distal end portions 20C and 20*d* of the lowermost array 94*b* of pipette tips 20 for protection within a lower end of the container 80.

As shown in FIG. 10, additional inward projections 110 in corners of the sides 106 of the container 80, comprise horizontally separated series of triangular shaped ramps, spaced at equal intervals vertically above the support plate 82 so as to permit incremental downward movement of the push plate 96 and prevent an upward return movement thereof. As shown in FIG. 10, the inward projections 110 are positioned to constrain only the movement of the push plate 96 by contact with the corners thereof. As illustrated, bevelled corners of the carrier plates 84*a–h* do not permit the inward projections 110 to contact the peripheral edges of carrier plates. The incremental downward movement of the push plate 96 thereby affects a sequential releasing of the lowermost array 94*b* of pipette tips 20 contained in the support plate 82 into the tip rack 92 and a positioning of the lowermost carrier plate 84*a* as the support plate 82 for subsequent release.

As previously stated, release of the support plate 82 results from the downward pressure of the push plate 96 applied against the proximal end portions 20P of the uppermost array 94*j* of pipette tips 20 and thereby against the carrier plate 84*h* and thereafter through the arrays 94*b–i* of pipette tips and carrier plates 84*a–g*. The downward pressure of the support plate 82 against the projections 108 causes sides 106 to flex outward slightly, for releasing the support plate 82 into the tip rack 92 below.

Thus, it should be appreciated from the foregoing that the improved large maximized internal volume pipette tip design shown in FIGS. 3A and 3B, enables large volume pipette tips (500 microliter and above) to be contained in standard tip racks including support trays having rectilinear arrays of tip receiving holes spaced on 9 mm centers and to be contained in standard tip rack refill packs wherein such tips are arranged in vertically stacked arrays on 9 mm centers with vertically aligned pipette tips nesting freeing in a telescoping configuration.

While particularly preferred large maximized internal volume freely nestable pipette tips have been illustrated and described in detail above, both alone and in standard tip racks and refill packs, the dimensions and tapers of the surfaces of the pipette tip of the present invention may reside in ranges such as those indicated for a 1000 microliter tip. Therefore, the pipette tip of the present invention is not limited to the specific preferred embodiments illustrated and described. Further, although standard pipette tip racks and refill packs are designed to contain pipette tips in rectilinear (X,Y) arrays, other tip racks and refill packs may be designed with the arrays of support holes on axis in other than X and Y directions but still spaced on 9 mm centers. Therefore, rather than being restricted to the foregoing preferred embodiments, the present invention is to be limited only by the terms of the following claims.

We claim:

1. In a pipette tip rack including a base and vertically extending side members, the combination of a horizontally extending pipette tip support tray over the base of the tip rack and a plurality of large maximized internal volume freely nestable pipette tips having an internal volume of 500 microliters or more, the support tray including a plurality of through holes arranged in an array, each hole having a center which is spaced a distance "s" from centers of immediately adjacent through holes, "s" being approximately 9 millimeters, each pipette tip having a substantially cylindrical proximal portion and an elongated generally conical distal portion coaxial with and joined to its proximal portion adjacent a downwardly facing outwardly extending shoulder and including at a distal tip end a relatively small orifice for receiving and dispensing fluid into and from the pipette tip upon operation of a pipette to which the pipette tip is mounted, the proximal portion of each pipette tip having an outer diameter equal to or approximately equal to but less than "s" and a conical inner surface for receiving and releasably attaching to a pipette tip mounting shaft of the pipette, the distal portion of each pipette tip being vertically oriented in a different one of the through holes in the support tray with its shoulder on a top of the support tray for support thereby to form a first array of pipette tips supported by the pipette tip rack, and the distal portion of each pipette tip further including substantially parallel inner and outer surfaces tapering inward in a downward direction relative to a vertical longitudinal axis of the pipette tip to maximize the inner volume of the central portion and for spacing from an outer surface of a similar pipette tip of a second array of pipette tips when nesting in the first array of pipette tips.

2. The combination of claim 1 wherein the distal portion of each tip has an internal volume of at least 1000 microliters and inner and outer surfaces having a rate of inward taper in a range of approximately 1.3 to 2.0 degrees from the vertical longitudinal axis of the pipette.

3. The combination of claim 2 wherein each pipette tip has an inner diameter at its proximal end of approximately 7.7 millimeters.

4. The combination of claim 1 wherein the distal portion of each tip comprises an elongated frusto-conical central portion coaxial with and joined to its proximal portion and a cone shaped distal end portion contiguous and coaxial with the central portion and including the small orifice, the central portion of each pipette tip being vertically oriented in a different one of the through holes in the support tray and including the substantially parallel inner and outer surfaces.

5. The combination of claim 4 wherein the distal end portion of each pipette tip includes an outer surface which tapers at a greater angle than an inner surface of the distal end portion to define a sidewall of narrowing thickness adjacent to the orifice.

6. The combination of claim 4 wherein the central portion and distal end portion of each pipette tip have a combined internal volume of at least 1000 microliters.

7. The combination of claim 6 wherein the inner and outer surfaces of the central portion of each pipette tip have rates of inward taper in a range of approximately 1.3 to 2.0 degrees from the vertical longitudinal axis of the pipette tip.

8. The combination of claim 7 wherein the rate of taper is approximately 1.5 degrees.

9. The combination of claim 7 wherein each pipette tip has a length of approximately 8.6 centimeters, an inner diameter at its proximal end of approximately 7.7 millimeters, the central portion having a length of approximately 4 centimeters and the distal end portion having a length of approximately 2 centimeters.

10. The combination of claim 9 wherein:

the inner surface of the central portion of each pipette tip has a rate of taper of approximately 1.5 degrees relative to the vertical longitudinal axis of the pipette tip; and the distal end portion includes an inner surface having a rate of taper of approximately 4.7 degrees from the vertical longitudinal axis and an outer surface having a rate of taper of approximately 5.6 degrees to the vertical longitudinal axis of the pipette tip.

11. In a pipette tip rack refill pack including a vertically extending housing having an open bottom and a horizontally extending pipette tip support plate over the open bottom and including a plurality of through holes arranged in an array, each hole having a center which is spaced a distance "s" from centers of immediately adjacent through holes, "s" being approximately 9 millimeters, and a horizontally extending carrier plate within the housing above the support plate and including a plurality of through holes matching the array of holes in the support plate:

a first and a second array of large maximized internal volume freely nestable pipette tips having an internal volume of 500 microliters or more, each pipette tip having a substantially cylindrical proximal portion and an elongated generally conical distal portion coaxial with and joined to its proximal portion adjacent a downward facing outwardly extending shoulder and including at a distal tip end a relatively small orifice for receiving and dispensing fluid into and from the pipette tip upon operation of a pipette to which the pipette tip is mounted, the proximal portion of each pipette tip having an outer diameter equal to or approximately equal to but less than "s" and a conical inner surface for receiving and releasably attaching to a pipette tip mounting shaft of the pipette, the distal portion of each pipette tip including substantially parallel inner and outer surfaces tapering inward in a downward direction relative to a vertical longitudinal axis of the pipette tip to maximize the inner volume of the distal portion and for spacing from an outer surface of a pipette tip of the second array of pipette tips nesting in the first array of pipette tips, the distal portion of each pipette tip in the first array being vertically oriented in a different one of the through holes in the support plate with its shoulder on a top of the support plate for support thereby and the distal portion of each pipette tip in the second array being vertically oriented in a different one of the through holes in the carrier plate with its shoulder on a top of the carrier plate for support thereby with the distal portion extending into and nesting in a pipette tip in the first array with the outer surface of the distal portion spaced slightly from the inner surface of the distal portion of the pipette tip into which it is nesting.

12. The combination of claim 11 wherein the distal portion of each tip has an internal volume of at least 1000 microliters and inner and outer surfaces having a rate of inward taper in a range of approximately 1.3 to 2.0 degrees from the vertical longitudinal axis of the pipette.

13. The combination of claim 12 wherein each pipette tip has an inner diameter at its proximal end of approximately 7.7 millimeters.

14. The combination of claim 11 wherein the distal portion of each tip comprises an elongated frusto-conical central portion coaxial with and joined to its proximal portion and a cone shaped distal end portion contiguous and coaxial with the central portion and including the small orifice, the central portion of each pipette tip being vertically oriented in a different one of the through holes in the support tray and including the substantially parallel inner and outer surfaces.

15. The combination of claim 14 wherein the distal end portion of each pipette tip includes an outer surface which tapers at a slightly greater angle than an inner surface of the distal end portion to define a sidewall of narrowing thickness adjacent to the orifice.

16. The combination of claim 14 wherein the central portion and distal end portion of each pipette tip have a combined internal volume of at least 1000 microliters.

17. The combination of claim 16 wherein the inner and outer surfaces of the central portion of each pipette tip have a rates of inward taper in a range of approximately 1.3 to 2.0 degrees from the vertical longitudinal axis of the pipette tip.

18. The combination of claim 17 wherein the rate of taper is approximately 1.5 degrees.

19. The combination of claim 17 wherein each pipette tip has a length of approximately 8.6 centimeters, an inner diameter at its proximal end of approximately 7.7 millimeters, the central portion having a length of approximately 4 centimeters and the distal end portion having a length of approximately 2 centimeters.

20. The combination of claim 19 wherein:

the inner surface of the central portion of each pipette tip has a rate of taper of approximately 1.5 degrees relative to the vertical longitudinal axis of the pipette tip; and the distal end portion an inner surface having a rate of taper of approximately 4.6 degrees from the vertical longitudinal axis and an outer surface having a rate of taper of approximately 5.7 degrees to the vertical longitudinal axis of the pipette tip.

21. In a pipette tip rack refill pack including a vertically extending housing having an open bottom and a horizontally extending pipette tip support plate over the open bottom including a plurality of enlargeable through holes arranged in an array, each hole having a center which is spaced a distance "s" from centers of immediately adjacent through holes, "s" being approximately 9 millimeters:

first and second arrays of large maximized internal volume freely nestable pipette tips having an internal volume of 500 microliters or more, each pipette tip having a substantially cylindrical proximal portion and an elongated generally conical distal portion coaxial with and joined to the proximal portion adjacent a downward facing outwardly extending shoulder and including a relatively small orifice for receiving and dispensing fluid into and from the pipette tip upon operation of a pipette to which the pipette tip is mounted, the proximal portion of each pipette tip having an outer diameter equal to or approximately equal to but less than "s" and a conical inner surface for receiving and releasably attaching to a pipette tip mounting shaft of the pipette, and the distal portion of each pipette tip including substantially parallel inner and outer surfaces tapering inward in a downward direction relative to a vertical longitudinal axis of the pipette tip to maximize the inner volume of the distal portion and for spacing from an outer surface of a pipette tip of the second array of pipette tips nesting in the first array of pipette tips, the distal portion of each pipette tip in the first array being vertically oriented in a different one of the enlargeable through holes in the support plate with its shoulder on a top of the support plate for support thereby and the distal portion of each of the pipette tips in the second array being vertically oriented in an open proximal end of a different one of the tips in the first array with its shoulder bearing on a top of a pipette tip in the first array for support thereby with the outer surface of the distal portion spaced from the inner surface of the distal portion of the pipette tip with which it is nesting.

22. The combination of claims 21 wherein the distal portion of each tip comprises an elongated frusto-conical central portion coaxial with and joined to its proximal portion and a cone shaped distal end portion contiguous and coaxial with the central portion and including the small orifice, the central portion of each pipette tip being vertically oriented in a different one of the through holes in the support tray and including the substantially parallel inner and outer surfaces.

23. The combination of claim 22 wherein the distal end portion of each pipette tip includes an outer surface which tapers inward at a greater angle than an inner surface of the distal end portion to define a sidewall of narrowing thickness adjacent to the orifice.

24. The combination of claims 21 wherein the distal portion of each tip has an internal volume of at least 1000 microliters and inner and outer surfaces having a rate of inward taper in a range of approximately 1.3 to 2.0 degrees from the vertical longitudinal axis of the pipette.

25. The combination of claim 24 wherein each pipette tip has an inner diameter at its proximal end of approximately 7.7 millimeters.

26. The combination of claim 21 wherein the central portion and distal end portion of each pipette tip have a combined internal volume of at least 1000 microliters.

27. The combination of claim 26 wherein the inner and outer surfaces of the central portion of each pipette tip have rates of inward taper in a range of approximately 1.3 to 2.0 degrees from the vertical longitudinal axis of the pipette tip.

28. The combination of claims 27 wherein the rate of taper is approximately 1.5 degrees.

29. The combination of claim 27 wherein each pipette tip has a length of approximately 8.6 centimeters, an inner diameter at its proximal end of approximately 7.7 millimeters, the central portion having a length of approximately 4 centimeters and the distal end portion having a length of approximately 2 centimeters.

30. The combination of claim 29 wherein:

the inner surface of the central portion of each pipette tip has a rate of taper of approximately 1.5 degrees relative to the vertical longitudinal axis of the pipette tip; and the distal end portion including an inner surface having a rate of taper of approximately 4.7 degrees from the vertical longitudinal axis and an outer surface having a rate of taper of approximately 5.6 degrees to the vertical longitudinal axis of the pipette tip.

31. A plurality of large maximized internal volume freely nestable pipette tips having an internal volume of 500 microliters or more for mounting in a standard pipette tip rack or refill pack including a horizontally extending pipette tip support having a plurality of through holes arranged in an array, each hole having a center which is spaced a distance "s" from centers of immediately adjacent through holes, "s" being approximately 9 millimeters:

each pipette tip having a substantially cylindrical proximal portion, an elongated generally conical distal portion coaxial with and joined to the proximal end portion adjacent a downward facing outwardly extending shoulder and including a relatively small orifice for receiving and dispensing fluid into and from the pipette tip upon operation of a pipette to which the pipette tip is mounted, the proximal portion of each pipette tip having an outer diameter equal to or approximately equal to but less than "s" and a conical inner surface for receiving and releasably attaching to a pipette tip mounting shaft of the pipette, the distal portion of each pipette tip being vertically mountable in a different one of the through holes in the support with its shoulder on a top of the support for support thereby to form a first array of pipette tips supported by the pipette tip rack, and the distal portion of each pipette tip further including substantially parallel inner and outer surfaces tapering inward in a downward direction relative to a vertical longitudinal axis of the pipette tip to maximize the inner volume of the central portion and for spacing slightly from an outer surface of a similar pipette tip of a second array of pipette tips for nesting in the first array of pipette tips.

32. The pipette tips of claims 31 wherein the distal portion of each tip has an internal volume of at least 1000 microliters and inner and outer surfaces having a rate of inward taper in a range of approximately 1.3 to 2.0 degrees from the vertical longitudinal axis of the pipette.

33. The combination of claim 32 wherein each pipette tip has an inner diameter at its proximal end of approximately 7.7 millimeters.

34. The plurality of pipette tips of claim 31 wherein the distal portion of each tip comprises an elongated frusto-conical central portion coaxial with and joined to its proximal portion and a cone shaped distal end portion contiguous and coaxial with the central portion and including the small orifice, the central portion of each pipette tip being vertically oriented in a different one of the through holes in the support tray and including the substantially parallel inner and outer surfaces.

35. The pipette tips of claim 34 wherein the distal end portion of each pipette tip includes an outer surface which tapers at a greater angle than an inner surface of the distal end portion to define a sidewall of narrowing thickness adjacent to the orifice.

36. The pipette tips of claim 34 wherein the central portion and distal end portion of each pipette tip have a combined internal volume of at least 1000 microliters.

37. The pipette tips of claim 34 wherein:

the inner surface of the central portion of each pipette tip has a rate of taper of approximately 1.5 degrees relative to the vertical longitudinal axis of the pipette tip; and the distal end portion of each pipette tip includes an inner surface having a rate of taper of approximately 4.7 degrees from the vertical longitudinal axis and an outer surface having a rate of taper of approximately 5.6 degrees to the vertical longitudinal axis of the pipette tip.

38. The pipette tips of claim 34 wherein the inner and outer surfaces of the central portion of each pipette tip have a rates of taper of in a range of approximately 1.3 to 2.0 degrees from the vertical longitudinal axis of the pipette tip.

39. The pipette tips of claim 38 wherein the rate of taper is approximately 1.5 degrees.

40. The pipette tips of claim 38 wherein each pipette tip has a length of approximately 8.6 centimeters, an inner diameter at its proximal end of approximately 7.7 millimeters, a central portion having a length of approximately 4 centimeters and a distal end portion having a length of approximately 2 centimeters.

41. A large maximized internal volume freely nestable pipette tip having an internal volume of 500 microliters or more for mounting in a standard pipette tip rack or refill pack including a horizontally extending pipette tip support having a plurality of through holes arranged in an array, each hole having a center which is spaced a distance "s" from centers of immediately adjacent through holes, "s" being approximately 9 millimeters, the pipette tip comprising:

a substantially cylindrical proximal portion;

an elongated generally conical distal portion coaxial with and joined to the proximal end portion adjacent a downward facing outwardly extending shoulder and including a relatively small orifice for receiving and dispensing fluid into and from the pipette tip upon operation of a pipette to which the pipette tip is mounted;

the proximal portion of the pipette tip having an outer diameter equal to or approximately equal to but less than "s" and a conical inner surface for receiving and releasably attaching to a pipette tip mounting shaft of the pipette;

the distal portion of the pipette tip being vertically mountable in a different one of the through holes in the support with its shoulder on a top of the support for support thereby; and the distal portion of the pipette tip further including substantially parallel inner and outer surfaces tapering slightly inward in a downward direction relative to a vertical longitudinal axis of the pipette tip to maximize the inner volume of the distal portion and for spacing slightly from an outer surface of a similar pipette tip for nesting in the pipette tip.

42. The pipette tip of claim 41 wherein the distal portion of each tip comprises an elongated frusto-conical central portion coaxial with and joined to its proximal portion and a cone shaped distal end portion contiguous and coaxial with the central portion and including the small orifice, the central portion of each pipette tip being vertically oriented in a different one of the through holes in the support tray and including the substantially parallel inner and outer surfaces.

43. The pipette tip of claim 41 wherein the conical inner surface of the proximal portion extends from an open end of the proximal portion to a conical sealing region dimensioned to receive the mounting shaft of the pipette.

* * * * *